US006945878B2

(12) United States Patent
Binette et al.

(10) Patent No.: US 6,945,878 B2
(45) **Date of Patent: *Sep. 20, 2005**

(54) PERIMETER WEIGHTED MULTI-LAYER GOLF BALL

(75) Inventors: Mark L. Binette, Ludlow, MA (US); R. Dennis Nesbitt, Beverly Hills, FL (US); Thomas J. Kennedy, III, Wilbraham, MA (US); John L. Nealon, Springfield, MA (US); Michael J. Sullivan, Barrington, RI (US)

(73) Assignee: Callaway Golf Company, Carlsbad, CA (US)

( * ) Notice: Subject to any disclaimer, the term of this patent is extended or adjusted under 35 U.S.C. 154(b) by 92 days.

This patent is subject to a terminal disclaimer.

(21) Appl. No.: 10/662,196

(22) Filed: Sep. 11, 2003

(65) Prior Publication Data

US 2004/0063517 A1 Apr. 1, 2004

Related U.S. Application Data

(63) Continuation of application No. 09/760,251, filed on Jan. 12, 2001, now abandoned, which is a continuation-in-part of application No. 09/431,533, filed on Nov. 1, 1999, now Pat. No. 6,315,681, and a continuation-in-part of application No. 09/049,868, filed on Mar. 27, 1998, now Pat. No. 5,984,806, which is a continuation-in-part of application No. 08/782,221, filed on Jan. 13, 1997, now Pat. No. 6,015,356.

(60) Provisional application No. 60/042,428, filed on Mar. 28, 1997.

(51) Int. Cl.[7] ..... A63B 37/06

(52) U.S. Cl. ..... 473/373; 473/378

(58) Field of Search ..... 473/367, 368, 473/371, 372, 373, 374, 376, 377, 356

(56) References Cited

U.S. PATENT DOCUMENTS

| | | | | | |
|---|---|---|---|---|---|
| 1,470,302 | A | * | 10/1923 | Thomas | 473/359 |
| 4,884,814 | A | * | 12/1989 | Sullivan | 473/372 |
| 4,911,451 | A | | 3/1990 | Sullivan et al. | |
| 5,026,067 | A | | 6/1991 | Gentiluomo | |
| 5,048,838 | A | | 9/1991 | Chikaraish et al. | |
| 5,215,304 | A | | 6/1993 | Pinel, Jr. et al. | |
| 5,222,739 | A | | 6/1993 | Horiuchi et al. | |
| 5,244,969 | A | | 9/1993 | Yamada | |
| 5,273,286 | A | | 12/1993 | Sun | |
| 5,274,041 | A | | 12/1993 | Yamada | |
| 5,298,571 | A | | 3/1994 | Statz et al. | |
| 5,427,378 | A | | 6/1995 | Murphy | |
| 5,439,227 | A | | 8/1995 | Egashira et al. | |
| 5,662,534 | A | | 9/1997 | Kroll et al. | |
| 5,688,869 | A | | 11/1997 | Sullivan | |
| 5,713,802 | A | * | 2/1998 | Moriyama et al. | 473/374 |
| 5,714,546 | A | * | 2/1998 | Egashira et al. | 473/378 |
| 5,730,664 | A | * | 3/1998 | Asakura et al. | 473/373 |
| 5,762,568 | A | * | 6/1998 | Kato | 473/365 |
| 5,779,561 | A | | 7/1998 | Sullivan et al. | |
| 5,779,563 | A | * | 7/1998 | Yamagishi et al. | 473/371 |
| 5,810,678 | A | | 9/1998 | Cavallaro et al. | |
| 5,879,244 | A | * | 3/1999 | Hwang | 473/373 |
| 5,984,806 | A | * | 11/1999 | Sullivan et al. | 473/373 |
| 6,037,419 | A | | 3/2000 | Takesue et al. | |
| 6,045,460 | A | | 4/2000 | Hayashi et al. | |
| 6,095,932 | A | | 8/2000 | Umezawa et al. | |
| 6,359,066 | B1 | | 3/2002 | Yabuki | |

* cited by examiner

*Primary Examiner*—Raeann Gorden
(74) *Attorney, Agent, or Firm*—Michael A. Catania; Elaine H. Lo

(57) ABSTRACT

A golf ball is described that includes a spherical core, an inner cover or mantle layer, and an outer cover layer. A wide array of ionomeric materials are noted for use in the various cover layers. The mantle and the outer cover layers exhibit different Shore D hardness values and at least one of the layers includes a heavy weight filler material to enhance the interior perimeter weight of the ball. In several particular versions of the golf balls, the filler material is present in an amount of at least 10% by weight based upon the weight of the layer or layers within which the filler material is incorporated.

18 Claims, 3 Drawing Sheets

PERIMETER WEIGHTED MULTI-LAYER GOLF BALL

CROSS-REFERENCES TO RELATED APPLICATIONS

This application is a continuation of U.S. application Ser. No. 09/760,251 filed Jan. 12, 2001 now abandoned which is a continuation-in-part application of U.S. application Ser. No. 09/431,533 filed Nov. 1, 1999 now U.S. Pat. No. 6,315,681, which is a continuation-in-part of U.S. application Ser. No. 08/782,221 filed Jan. 13, 1997, now U.S. Pat. No. 6,015,356, and a continuation-in-part of U.S. application Ser. No. 09/049,868 filed Mar. 27, 1998, now U.S. Pat. No. 5,984,806; which claims priority from U.S. Provisional Application Ser. No. 60/042,428 filed Mar. 28, 1997.

FIELD OF THE INVENTION

This invention relates to golf balls. In particular, the present invention relates to a three-piece golf ball having a solid, wound, or liquid core and two or more cover layers. Preferably, at least one of the cover layers contains density-adjusting filler material. Preferably, one or more of the cover layers comprises an ionomeric material and most preferably is a magnesium, zinc, sodium, or lithium neutralized ionomer, or blend thereof. Preferably, the outer cover layer is a blend of hard and soft ionomers, or is a terpolymer ionomer. The outer cover layer is relatively soft, having a preferred Shore D hardness in the range of 58 to 65, and most preferably 60 to 63.

BACKGROUND OF THE INVENTION

According to United States Golf Association (U.S.G.A.) rules, a golf ball may not have a weight in excess of 1.620 ounces or a diameter smaller than 1.680 inches. The initial velocity of U.S.G.A. "regulation" balls may not exceed 250 feet per second with a maximum tolerance of 2%. Initial velocity is measured on a standard machine maintained by the U.S.G.A. wherein a projection on a wheel rotating at a defined speed hits a test ball, and the period of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance plus 4% and a 2% tolerance for test error.

These specifications limit how far a golf ball will travel in several ways when hit. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and thus, a lower drag when traveling through the air. Increasing the initial velocity increases the distance the ball will travel.

The foregoing generalizations hold when the effect of size, weight, or initial velocity is measured in isolation. Flight characteristics primarily (influenced by dimple pattern and ball rotation properties), club head speed, radius of gyration, and diverse other factors also influence the distance a ball will travel.

In the manufacture of top-grade golf balls for use by professional golfers and amateur golf enthusiasts, the distance a ball will travel when hit (hereinafter referred to as "distance") is an important design criterion. Since the U.S.G.A. rules were established, golf ball manufacturers have designed top-grade U.S.G.A. regulation balls to be as close to the maximum weight, minimum diameter, and maximum initial velocity as golf ball technology will permit. The distance a ball will travel when hit has, however, been improved by changes in raw materials and by alterations in dimple configuration.

Golf balls not conforming in various respects to U.S.G.A. specifications have been made in the United States. Prior to the effective date of the U.S.G.A. rules, balls of various weights, diameters, and resiliencies were common. So-called "rabbit balls," which claim to exceed the U.S.G.A. initial velocity limitations, have also been offered for sale. Recently, oversized, overweight golf balls have been on sale for use as golf teaching aids (see U.S. Pat. No. 4,201,384 to Barber).

Oversized golf balls are also disclosed in New Zealand Patent 192,618 dated Jan. 1, 1980, issued to a predecessor of the present assignee. This patent discloses an oversized golf ball having a diameter between 1.700 and 1.730 inches and an oversized core of resilient material so as to increase the coefficient of restitution. Additionally, the patent discloses that the ball should include a cover having a thickness less than the cover thickness of conventional balls. The patent does not disclose any dimple size or the percentage of surface coverage by the dimples.

Golf balls made by Spalding in 1915 were of a diameter ranging from 1.630 inches to 1.710 inches. While these balls had small shallow dimples, they covered less than 50% of the surface of the ball. Additionally, as the diameter of the ball increased, the weight of the ball also increased.

Golf balls known as the LYNX JUMBO were produced and sold in October of 1979. This ball had a diameter of substantially 1.80 inches. The dimple patterns on the LYNX JUMBO balls had 336 Atti-type dimples with each dimple having a diameter of 0.147 inch and a depth of 0.0148 inch. With this dimple arrangement, 56.02% of the surface area of the ball was covered by the dimples. This ball met with little or no commercial success.

Top-grade golf balls sold in the United States may generally be classified as one of two types; two-piece or three-piece. The two-piece ball, exemplified by the balls sold by Spalding Corporation under the trademark TOP-FLITE, comprises a solid polymeric core and a separately formed cover. The so-called three-piece balls, exemplified by the balls sold under the trademark TITLEIST by the Acushnet Company, comprise a liquid (e.g., TITLEIST TOUR 384) or solid (e.g., TITLEIST DT) center, elastomeric thread windings about the center, and a cover. Although the nature of the cover can, in certain instances, make a significant contribution to the overall coefficient of restitution and initial velocity of a ball (see, for example, U.S. Pat. No. 3,819,768 to Molitor), the initial velocity of two-piece and three-piece balls is determined mainly by the coefficient of restitution of the core. The coefficient of restitution of the core of wound balls can be controlled within limits by regulating the winding tension and the thread and center composition. With respect to two-piece balls, the coefficient of restitution of the core is a function of the properties of the elastomer composition from which it is made. Solid cores today are typically molded using polybutadiene elastomers mixed with acrylate or methacrylate metal salts. High-density fillers such as zinc oxide are included in the core material in order to achieve the maximum U.S.G.A. weight limit.

Improvements in cover and core material formulations and changes in dimple patterns have more or less continually improved golf ball distance for the last 20 years. In co-pending application Ser. No. 08/782,221 filed Jan. 13, 1997 which is owned by the present assignee, now U.S. Pat. No. 6,015,356, there is disclosed a multi-layer golf ball having a diameter of generally 1.68–1.69 inches wherein one or more cover layers contains a heavy weight filler material to enhance the interior perimeter weight of the ball.

Top-grade golf balls, however, must meet several other important design criteria. To successfully compete in today's golf ball market, a golf ball should be resistant to cutting and must be finished well; it should hold a line in putting and should have good click and feel. With a well-designed ball, experienced players can better execute shots involving draw, fade, or abrupt stops, as the situation dictates.

SUMMARY OF THE INVENTION

The present invention meets all of the previously noted objectives. In a first aspect, the present invention provides a multi-layer golf ball comprising a core assembly, a first cover layer disposed about the core assembly, and a second cover layer disposed on the first cover layer. The second cover layer defines a plurality of dimples along the exterior face of the golf ball and has a hardness that is less than, i.e. softer than, the hardness of the first inner cover layer. The golf ball further includes at least 10 parts by weight of a density-increasing filler material which is disposed in one of, or both, the first inner cover layer and the second outer cover layer.

In another aspect of the present invention, a multi-layer golf ball is provided comprising a core, and a multi-layer cover assembly disposed about the core. The cover assembly includes a first cover layer disposed on the core. The first cover layer comprises an ionomeric material. The cover assembly further includes a second outermost cover layer disposed on the inner cover layer. The second cover layer defines dimples along the exterior face of the golf ball such that the dimples constitute at least 70 percent of the surface area of the golf ball. The outer cover layer has a hardness that is softer than the hardness of the first inner cover layer and within the range of from about 58 to about 65 on the Shore D scale. The golf ball further comprises at least 10 parts by weight of a density-increasing filler material disposed in at least one of the first inner cover layer and the second outer cover layer.

In yet another aspect, the present invention provides a golf ball comprising a core, an interior layer disposed on the core, an outer cover layer disposed on the interior layer, and at least 10 parts by weight of a filler material present in at least one of the interior and outer cover layers. In this aspect, the core is either a solid core, a liquid core, or a wound core. Regarding the interior layer, that layer comprises an ionomeric material selected from the group consisting of a magnesium ionomer, a zinc ionomer, a sodium ionomer, a lithium ionomer, or blends thereof. Concerning the outer cover layer, the outer cover layer defines a plurality of dimples along the exterior face of the cover layer such that the dimples constitute at least about 70 percent of the surface area of the golf ball. The outer layer has a Shore D hardness of from about 58 to about 65. And, the filler material contained in the ball constitutes at least 10 percent by weight of the layer or layers within which the filler material is disposed.

BRIEF DESCRIPTION OF THE DRAWINGS

Other objects and advantages of the invention will become apparent from a study of the following specification when viewed in the light of the accompanying drawings, in which.

DETAILED DESCRIPTION OF THE PREFERRED EMBODIMENTS

Figure 1:
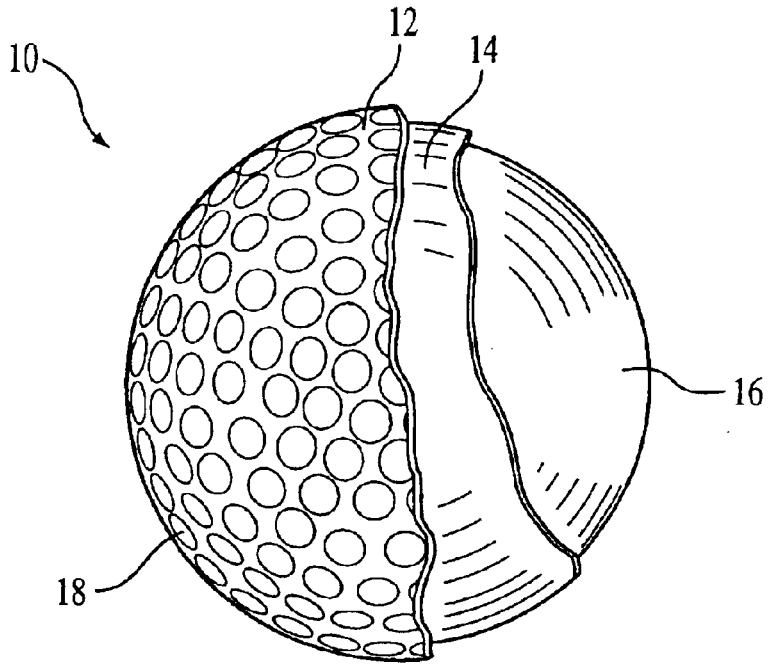
FIG. 1 is a partial sectional view of a preferred embodiment golf ball according to the present invention.

FIG. 1 illustrates the basic construction of a multi-layer golf ball according to the present invention. A preferred embodiment golf ball 10 comprises a core 16 surrounded by a mantle layer or interior cover layer 14 and an outer cover layer 12 which defines a plurality of dimples 18 about its surface area.

Preferably, the mantle or interior cover layer is formed of a hard ionomer or other hard polymer having a Shore D hardness of about 65 or more. The outer cover layer is preferably formed of a soft ionomer or other elastomer having a Shore D hardness of about 65 or less. It is more preferred that the outer cover layer have a Shore D hardness of from about 58 to about 65, and most preferably from about 60 to about 63. As described in greater detail herein, preferably, at least one of the cover layers comprises at least 10 weight percent of a density-adjusting filler material, and most preferably, a density-increasing filler material. The multi-layer balls having such inner and outer cover layers exhibit high coefficient of restitution (C.O.R.) values and have a greater travel distance in comparison to balls made with a single cover layer.

Moreover, the softer outer layer adds to the desirable "feel" and high spin rate of the struck ball while maintaining respectable resiliency. The soft outer layer allows the cover to deform more during impact and increases the area of contact between the face of a golf club and the ball cover, thereby imparting more spin on the ball. As a result, the soft cover provides the ball with a balata-like feel and playability characteristics with improved distance and durability.

The present invention also encompasses golf balls having relatively large diameters. In this embodiment, the golf ball has an outer diameter of at least 1.70 inches. The preferred diameter of the core is between about 1.20 and about 1.660 inches. The preferred thickness of the mantle layer is between about 0.020 and about 0.250 inches. The preferred thickness of the outer cover layer is also between about 0.020 and about 0.250 inches.

In order to enhance the internal perimeter weight of the golf ball, a heavy weight filler material is added to at least one of the mantle and cover layers according to a preferred embodiment of the invention. In order to prevent the weight of the ball from exceeding 1.620 ounces, the core is formed of a lighter soft compression material. A suitable material for the core is a diene polymer.

The heavy weight filler material is preferably a powdered metal selected from the group of powdered brass, tungsten, titanium, bismuth, boron, bronze, cobalt, copper, inconnel metal, iron, molybdenum, nickel, stainless steel, zirconium oxide, and aluminum. Other suitable filler materials are noted herein.

The mantle layer is preferably formed of a material with a Shore D hardness of at least 65. Suitable materials for the mantle layer for use in this embodiment, include an ionomer resin, a polyamide, a polyurethane, a polyphenylene oxide, and a polycarbonate. Additional materials are noted herein.

The cover layer utilized in this preferred embodiment is preferably formed of a material with a Shore D hardness of less than 65. Suitable materials include an ionomer resin, a thermoplastic elastomer, a thermosetting elastomer, a polyurethane, a polyester, and a polyester amide. Other materials are noted herein.

Preferably, in this embodiment, the core has a diameter of about 1.50 inches, the mantle layer has a thickness of about 0.050 and the cover layer has a thickness of about 0.055 inches, resulting in a ball having a diameter of about 1.710 inches. Slight variation, in core diameter and in the thickness of the mantle and cover layers will result in a ball having a diameter of between about 1.70 and about 1.76 inches.

Although the heavy weight filler material can be provided in one or both of the mantle and cover layers, there are some benefits to including it in the mantle layer. One benefit is that the mantle layer is typically harder than the cover layer, and the addition of powdered metal such as powdered brass to the mantle layer will not diminish the softness of the cover. Another benefit is that providing the filler in the mantle will not discolor the cover. If the filler is provided in the cover layer, it is necessary to paint the ball to the desired color since the filler will discolor the cover layer material.

Set forth in the following Tables 1, 2, and 3 are two different examples of the construction details for two multi-layer golf balls according to the preferred embodiment of the present invention.

TABLE 1

Core Details

| | Example 1 phr | Example 2 phr |
|---|---|---|
| Ingredients | | |
| Cariflex 1220 | 70 | 70 |
| Taktene 220 | 30 | 30 |
| Zinc Diacrylate (ZDA) | 20.5 | 19.5 |
| Zinc Oxide | 6 | 17 |
| Zinc Stearate | 20 | 20 |
| TG Regrind | 10 | 10 |
| 231 XL | 0.9 | 0.9 |
| Data | | |
| Size (inches) | 1.50 | 1.50 |
| Weight (g) | 31.0 g | 32.8 g |
| Compression (Riehle) | 125 | 125 |
| COR | 775 | 768 |
| Sp. Gr. | 1.07 | 1.132 |

TABLE 2

Mantle Details

| | % Acid | Type | Cation | Example 1 phr | Example 2 phr |
|---|---|---|---|---|---|
| Materials | | | | | |
| Iotek 1002 | 18% | AA | Na | 50 | 50 |
| Surlyn 7311 | 15% | MA | Mg | 50 | 50 |
| S. Steel Power | — | — | — | 30 | 0 |
| Data | | | | | |
| Size (inches) | | | | 1.60 | 1.60 |
| Thickness (inches) | | | | 0.050 | 0.050 |
| Sp. Gr. | | | | 1.18 | 0.97 |
| Weight (g) | | | | 36.5 | 36.5 |
| Compression (Riehle) | | | | 95 | 95 |
| COR | | | | 802 | 803 |
| Shore C/D | | | | 97/71 | 97/71 |

TABLE 3

Final Ball Details

| | % Acid | Type | Cation | Example 1 phr | Example 2 phr |
|---|---|---|---|---|---|
| Materials | | | | | |
| Surlyn 9910 | 15% | MA | Zn | 49.1 | 49.1 |
| Surlyn 8940 | 15% | MA | Na | 16.5 | 16.5 |
| Surlyn 8120 | 7% | MA | Na | 17.5 | 17.5 |
| Surlyn 8320 | 7% | MA | Na | 7.5 | 7.5 |
| TG White MB *I | 15% | AA | Zn | 9.4 | 9.4 |
| Final Ball Data | | | | | |
| Size (inches) | | | | 1.71 | 1.71 |
| Cover Thickness (inches) | | | | 0.055 | 0.055 |
| Sp. Gr. | | | | 0.98 | 0.98 |
| Weight (g) | | | | 45.5 | 45.5 |
| Compression (Riehle) | | | | 85 | 85 |
| COR | | | | 805 | 801 |
| Shore C/D | | | | 91/62 | 91/62 |

*I contains 75% Iotek 7030

The balls of the above examples exhibit improved playability characteristics and enhanced interior perimeter weighting. The heavy weight filler and smaller core produces a greater moment of inertia resulting in less initial spin, but greater spin retention, reduced slicing and hooking, and increased distance. The balls also have the same "feel" as softer balata covered balls.

Figure 2:
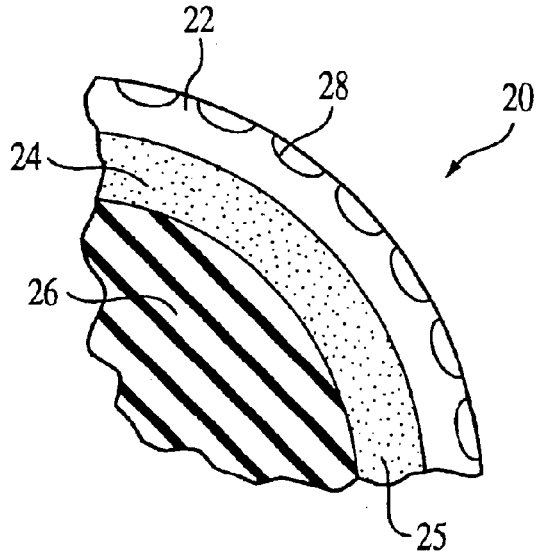
FIGS. 2–6 are partial cross-sectional views of additional preferred embodiment golf balls according to the present invention.

As noted, the preferred embodiment golf balls according to the present invention feature a relatively hard inner cover or mantle layer and a relatively soft outer cover layer. Particularly preferred embodiment golf balls are as follows. FIG. 2 illustrates a preferred embodiment golf ball 20 comprising a core 26, an inner cover layer 24 disposed about the core 26, and an outer cover layer 22 disposed on the inner cover layer 24. The outer cover layer 22 defines a plurality of dimples 28. The inner cover layer 24 comprises filler material 25, which is preferably a density-increasing filler material present in an amount of at least 10% by weight, based on the weight of the inner cover layer.

Figure 3:
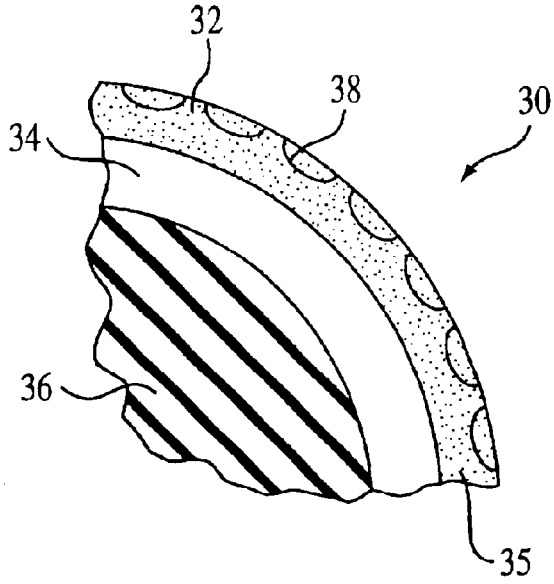

FIG. 3 illustrates another preferred embodiment golf ball 30 comprising a core 36, an inner cover layer 34 disposed about the core 36, and an outer cover layer 32 on the inner cover layer 34. The outer cover layer 32 defines a plurality of dimples 38 and comprises a filler material 35. Preferably, the filler material 35 is a density-increasing filler material and constitutes at least 10% by weight of the outer cover layer.

Figure 4:
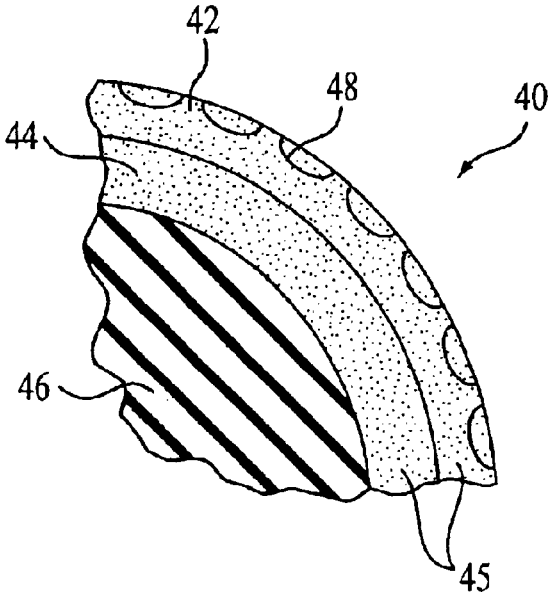

FIG. 4 illustrates another preferred embodiment golf ball 40 in accordance with the present invention. The golf ball 40 comprises a core 46, an inner cover layer 44, and an outer cover layer 42. The outer cover layer 42 defines a plurality of dimples 48 along the exterior of the golf ball 40. In this embodiment, both the inner cover layer 44 and the outer cover layer 42 contain filler material 45. The filler material 45 is present in an amount of at least 10% by weight of the total weight of the inner cover layer 44 and the outer cover layer 42.

Figure 5:
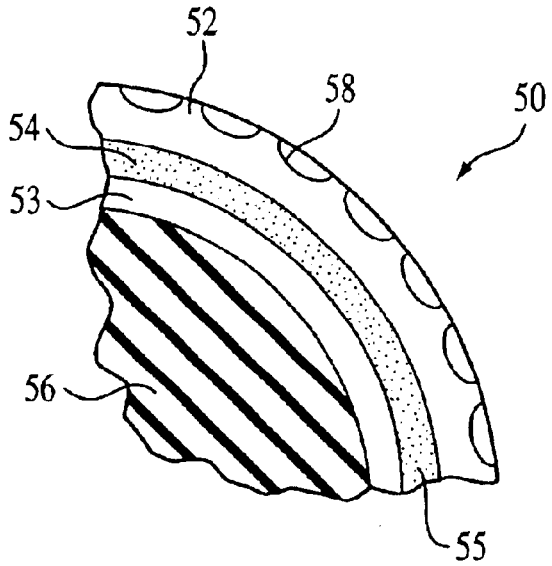

The present invention golf balls may also include one or more interior layers, disposed at any location between the core and the outer cover layer. For example, FIG. 5 illustrates another preferred embodiment golf ball 50 in accordance with the present invention. The golf ball 50 comprises a core 56, an optional layer 53 disposed about the core 56, an inner cover layer 54 disposed on the layer 53, and an outer cover layer 52 disposed on the inner cover layer 54. The outer cover layer 52 defines a plurality of dimples 58. The inner cover layer 54 comprises an effective amount of a filler material 55, which as described herein is a density-increasing material present in an amount of at least 10% based upon the layer within which the material is disposed.

Figure 6:
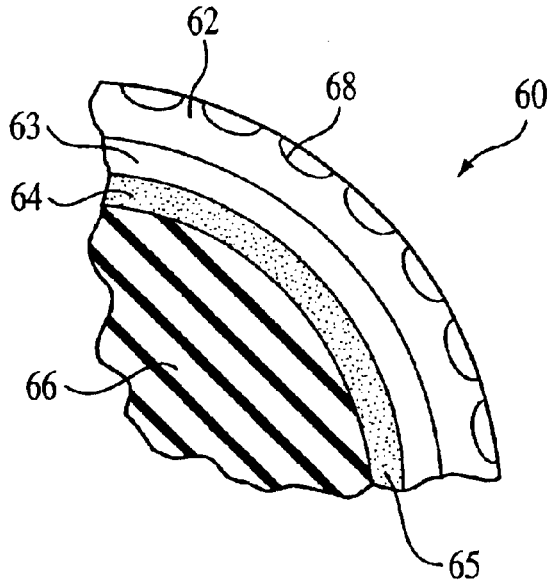

FIG. 6 illustrates yet another preferred embodiment golf ball 60 in accordance with the present invention. The golf ball 60 comprises a core 66, an inner cover layer 64 disposed on the core 66, an optional interior layer 63 disposed on the inner cover layer 64, and an exterior cover layer 62 disposed on the interior layer 63. The outer cover layer 62 defines a plurality of dimples 68 along the exterior of the ball 60. And, the inner cover layer 64 comprises filler material 65 as described herein.

In all of the golf ball embodiments described above, the balls have a weight no greater than 1.62 ounces. Also, the recited dimensions are all subject to a manufacturing tolerances of ±0.05%.

Dimple Configurations

The preferred embodiment golf balls according to the present invention utilize dimple configurations that are the subject of U.S. Pat. Nos. 5,503,397 and 5,833,554, both of which are hereby incorporated by reference.

Referring to FIGS. 3 and 4 of U.S. Pat. No. 5,503,397, there is shown a ball having a dimple pattern including 422 dimples, which includes dimples of three different diameters and depths measured in accordance with FIG. 2 of that patent. As indicated in those figures, the largest dimple 33 diameter is 0.169 inch with a dimple depth of 0.0123 inch, the intermediate dimple 35 diameter is 0.157 inch with a dimple depth of 0.0123 inch, and the smallest dimple 31 diameter is 0.145 inch with a dimple depth of 0.0101 inch. With the pattern shown, the resultant weighted average dimple diameter is 0.1478 inch and the weighted average dimple depth is 0.0104 inch. With this configuration and dimple size, 78.4% of the surface area of the ball is covered by dimples without any dimple overlap. The ball of FIG. 3 of the '397 patent includes repeating patterns bounded by lines 21, 23 and 25 about each hemisphere, with the hemispheres being identical. One such pattern is shown in FIG. 4, which indicates the arrangement of dimples and the relative sizes of the dimples in that particular pattern.

A further dimple pattern is shown in the figures of U.S. Pat. No. 5,833,554. This golf ball has 410 dimples comprising 138 dimples having a diameter of 0.169 inch and a depth of 0.0116 inch, 160 dimples having a diameter of 0.143 inch and a depth of 0.0101 inch, and 112 dimples having a diameter of 0.112 inch and a depth of 0.0077 inch. The configuration of the dimples comprises a dimple-free equatorial line E—E dividing the ball into two hemispheres having substantially identical dimple patterns. The dimple pattern of each hemisphere comprises a first plurality of dimples extending in four spaced clockwise arcs between the pole and the equator of each hemisphere, a second plurality of dimples extending in four spaced counterclockwise arcs between the pole and equator of each hemisphere, and a third plurality of dimples filling the surface area between the first and second plurality of dimples. In this ball, none of the dimples overlap. This pattern provides a weighted average dimple diameter of 0.1433 inch, a weighted average dimple depth of 0.010 inch, and a 73.1% coverage of the surface of the ball.

A still further modification is shown in FIG. 5 of the '554 patent hereby incorporated by reference. This golf ball has 422 dimples, all dimples having the same diameter of 0.143 inch and the same depth of 0.0103 inch. The dimples are arranged in a configuration so as to provide a dimple-free equatorial line, with each hemisphere of the ball having six identical dimpled substantially mating sections with a common dimple at each pole. FIG. 5 shows two mating sections having dimples 1 and 2, respectively. Each section comprises six dimples lying substantially along a line parallel with but spaced from the equatorial line, 29 dimples between the six dimples and the common polar dimple, with the outer dimples of each of the sections lying on modified sinusoidal lines 111 and 113.

Since only one diameter is used for all dimples, some small percentage of overlap occurs in order to provide substantial surface coverage with the dimples. For this particular pattern, there is an 11.4% (48) dimple overlap with a 73.2% coverage of the surface area of the ball. Overlap is determined by finding the number of dimples having an edge overlapping any other dimple and dividing that number by the total number of dimples on the ball, such number being expressed as a percentage.

In addition to the advantages discussed above, there is easier access to the ball with the club in both the fairway and rough because of the ball's size. This easier access allows for cleaner hits. Further, the increased size and moment results in the ball's ability to hold the line during putting. Thus, by increasing the percentage of dimple coverage of the surface of the ball, the ball has the advantages attributable to the larger ball while having enhanced flight characteristics as compared to previous balls having enlarged diameters.

Further aspects of preferred dimple configurations for the present invention golf balls are set forth in U.S. Pat. Nos. 5,766,098; and 5,273,287; both hereby incorporated by reference.

Additional details of the preferred materials, characteristics, and properties of the golf balls of the present invention are set forth below.

Cover Assembly

The multi-layered cover comprises two layers: a first or inner layer or ply 14 and a second or outer layer or ply 12. The inner layer 14 is comprised of a hard, high modulus (flexular modulus of 15,000 to 150,000 psi), low or high acid (i.e. greater than 16 weight percent acid) ionomer resin or ionomer blend. Preferably, the inner layer is comprised of a blend of two or more high acid (i.e. at least 16 weight percent acid) ionomer resins neutralized to various extents by different metal cations. The inner cover layer may or may not include a metal stearate (e.g., zinc stearate) or other metal fatty acid salt. The purpose of the metal stearate or other metal fatty acid salt is to lower the cost of production without affecting the overall performance of the finished golf ball.

The inner layer compositions include the high acid ionomers such as those recently developed by E.I. DuPont de Nemours & Company under the trademark "Surlyn®" and by Exxon Corporation under the trademark "Escor®" or trade name "Iotek", or blends thereof. Examples of compositions which may be used as the inner layer herein are set forth in detail in copending U.S. Ser. No. 07/776,803 filed Oct. 15, 1991, and Ser. No. 07/901,660 filed Jun. 19, 1992, both embodied in U.S. Pat. No. 5,688,869 incorporated herein by reference. Of course, the inner layer high acid ionomer compositions are not limited in any way to those compositions set forth in said copending applications. For example, the high acid ionomer resins recently developed by Spalding & Evenflo Companies, Inc., the assignee of the present invention, and disclosed in U.S. Ser. No. 07/901,660, filed Jun. 19, 1992, incorporated herein by reference, may also be utilized to produce the inner layer of the multi-layer cover used in the present invention.

The high acid ionomers which may be suitable for use in formulating the inner layer compositions of the subject invention are ionic copolymers which are the metal, i.e., sodium, zinc, magnesium, etc., salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (i.e., iso- or n-butylacrylate, etc.) can also be included to produce a softer terpolymer. The carboxylic acid groups of the copolymer are partially neutralized (i.e., approximately 10–75%, preferably 30–70%) by the metal ions. Each of the high acid ionomer resins which may be included in the inner layer cover compositions of the invention contains greater than about 16% by weight of a carboxylic acid, preferably from about 17% to about 25% by weight of a carboxylic acid, more preferably from about 18% to about 21.5% by weight of a carboxylic acid.

Although the inner layer cover composition preferably includes a high acid ionomeric resin and the scope of the patent embraces all known high acid ionomeric resins falling within the perimeters set forth above, only a relatively limited number of these high acid ionomeric resins have recently become commercially available.

The high acid ionomeric resins available from Exxon under the designation "Escor®" and or "Iotek", are somewhat similar to the high acid ionomeric resins available under the "Surlyn®" trademark. However, since the Escor®)/Iotek ionomeric resins are sodium or zinc salts of poly(ethylene-acrylic acid) and the "Surlyn®" resins are zinc, sodium, magnesium, etc. salts of poly(ethylene-methacrylic acid), distinct differences in properties exist.

Examples of the high acid methacrylic acid based ionomers found suitable for use in accordance with this invention include Surlyn® AD-8422 (sodium cation), Surlyn® 8162 (zinc cation), Surlyn® SEP-503-1 (zinc cation), and Surlyn® SEP-503-2 (magnesium cation). According to DuPont, all of these ionomers contain from about 18.5 to about 21.5% by weight methacrylic acid.

More particularly, Surlyn® AD-8422 is currently commercially available from DuPont in a number of different grades (i.e., AD-8422-2, AD-8422-3, AD-8422-5, etc.) based upon differences in melt index. According to DuPont, Surlyn® AD-8422 offers the following general properties set forth in Table 4, when compared to Surlyn®8920, the stiffest, hardest of all of the low acid grades (referred to as "hard" ionomers in U.S. Pat. No. 4,884,814):

TABLE 4

| | LOW ACID (15 wt % Acid) | HIGH ACID (>20 wt % Acid) | |
|---|---|---|---|
| | SURLYN ® 8920 | SURLYN ® 8422-2 | SURLYN ® 8422-3 |
| IONOMER | | | |
| Cation | Na | Na | Na |
| Melt Index | 1.2 | 2.8 | 1.0 |
| Sodium, Wt % | 2.3 | 1.9 | 2.4 |
| Base Resin MI | 60 | 60 | 60 |
| MP[1], ° C. | 88 | 86 | 85 |
| FP[1], ° C. | 47 | 48.5 | 45 |
| COMPRESSION MOLDING[2] | | | |
| Tensile Break, psi | 4350 | 4190 | 5330 |
| Yield, psi | 2880 | 3670 | 3590 |
| Elongation, % | 315 | 263 | 289 |
| Flex Mod, K psi | 53.2 | 76.4 | 88.3 |
| Shore D hardness | 66 | 67 | 68 |

[1]DSC second heat, 10° C./min heating rate.
[2]Samples compression molded at 150° C. annealed 24 hours at 60° C. 8422-2, -3 were homogenized at 190° C. before molding.

In comparing Surlyn® 8920 to Surlyn® 8422-2 and Surlyn® 8422-3, it is noted that the high acid Surlyn® 8422-2 and 8422-3 ionomers have a higher tensile yield, lower elongation, slightly higher Shore D hardness and much higher flexural modulus. Surlyn® 8920 contains 15 weight percent methacrylic acid and is 59% neutralized with sodium.

In addition, Surlyn® SEP-503-1 (zinc cation) and Surlyn® SEP-503-2 (magnesium cation) are high acid zinc and magnesium versions of the Surlyn® AD 8422 high acid ionomers. When compared to the Surlyn® AD 8422 high acid ionomers, the Surlyn SEP-503-1 and SEP-503-2 ionomers can be defined as set forth in Table 5 as follows:

TABLE 5

| Surlyn ® Ionomer | Ion | Melt Index | Neutralization % |
|---|---|---|---|
| AD 8422-3 | Na | 1.0 | 45 |
| SEP 503-1 | Zn | 0.8 | 38 |
| SEP 503-2 | Mg | 1.8 | 43 |

Furthermore, Surlyn® 8162 is a zinc cation ionomer resin containing approximately 20% by weight (i.e. 18.5–21.5% weight) methacrylic acid copolymer that has been 30–70% neutralized. Surlyn® 8162 is currently commercially available from DuPont.

Examples of the high acid acrylic acid based ionomers suitable for use in the present invention also include the Escor® or Iotek high acid ethylene acrylic acid ionomers produced by Exxon. In this regard, Escor® or Iotek 959 is a sodium ion neutralized ethylene-acrylic neutralized ethylene-acrylic acid copolymer. According to Exxon, Ioteks 959 and 960 contain from about 19.0 to about 21.0% by weight acrylic acid with approximately 30 to about 70 percent of the acid groups neutralized with sodium and zinc ions, respectively. The physical properties of these high acid acrylic acid based ionomers are set forth in Table 6 as follows:

TABLE 6

| PROPERTY | ESCOR ® (IOTEK) 959 | ESCOR ® (IOTEK) 960 |
|---|---|---|
| Melt Index, g/10 min | 2.0 | 1.8 |
| Cation | Sodium | Zinc |
| Melting Point, ° F. | 172 | 174 |
| Vicat Softening Point, ° F. | 130 | 131 |
| Tensile @ Break, psi | 4600 | 3500 |
| Elongation @ Break, % | 325 | 430 |
| Hardness, Shore D | 66 | 57 |
| Flexural Modulus, psi | 66,000 | 27,000 |

Additional high acid hard ionomer resins are also available from Exxon such as Iotek 1002 and Iotek 1003. Iotek 1002 is a sodium ion neutralized high acid ionomer (i.e., 18% by weight acid) and Iotek 1003 is a zinc ion neutralized high acid ionomer (i.e., 18% by weight acid). The properties of these ionomers are set forth below in Table 7:

TABLE 7

| IOTEK 1002 | | | |
|---|---|---|---|
| Property | Unit | Value | Method |
| General properties | | | |
| Melt index | g/10 min | 1.6 | ASTM-D 1238 |
| Density | kg/m$^3$ | | ASTM-D 1505 |
| Cation type | | Na | |
| Melting point | ° C. | 83.7 | ASTM-D 3417 |
| Crystallization point | ° C. | 43.2 | ASTM-D 3417 |
| Plaque properties | | | |
| Tensile at break | MPa | 31.7 | ASTM-D 638 |
| Tensile at yield | MPa | 22.5 | ASTM-D 638 |
| Elongation at break | % | 348 | ASTM-D 638 |
| 1% Secant modulus | MPa | 418 | ASTM-D 638 |
| 1% Flexural modulus | MPa | 380 | ASTM-D 790 |
| Hardness Shore D | | 62 | ASTM-D 2240 |
| Vicat softening point | ° C. | 51.5 | ASTM-D 1525 |

TABLE 8

| IOTEK 1003 | | | |
|---|---|---|---|
| Property | Unit | Value | Method |
| General properties | | | |
| Melt index | g/10 min | 1.1 | ASTM-D 1238 |
| Density | kg/m$^3$ | | ASTM-D 1505 |
| Cation type | | Zn | EXXON |
| Melting point | ° C. | 82 | ASTM-D 3417 |
| Crystallization point | ° C. | 51.5 | ASTM-D 3417 |
| Plaque properties | | | |
| Tensile at break | MPa | 24.8 | ASTM-D 638 |
| Tensile at yield | MPa | 14.8 | ASTM-D 638 |
| Elongation at break | % | 387 | ASTM-D 638 |
| 1% Secant modulus | MPa | 145 | ASTM-D 638 |
| 1% Flexural modulus | MPa | 147 | ASTM-D 790 |
| Hardness Shore D | | 54 | ASTM-D 2240 |
| Vicat softening point | ° C. | 56 | ASTM-D 1525 |

Furthermore, as a result of the development of a number of new high acid ionomers neutralized to various extents by several different types of metal cations, such as by manganese, lithium, potassium, calcium and nickel cations, several new high acid ionomers and/or high acid ionomer blends besides sodium, zinc and magnesium high acid ionomers or ionomer blends are now available for golf ball cover production. It has been found that these new cation neutralized high acid ionomer blends produce inner cover layer compositions exhibiting enhanced hardness and resilience due to synergies which occur during processing. Consequently, the metal cation neutralized high acid ionomer resins recently produced can be blended to produce substantially harder inner cover layers for multi-layered golf balls having higher C.O.R.'s than those produced by the low acid ionomer inner cover compositions presently commercially available.

More particularly, several new metal cation neutralized high acid ionomer resins have been produced by neutralizing, to various extents, high acid copolymers of an alpha-olefin and an alpha, beta-unsaturated carboxylic acid with a wide variety of different metal cation salts. This discovery is the subject matter of U.S. application Ser. No. 07/901,660, now embodied in U.S. Pat. No. 5,688,869 incorporated herein by reference. It has been found that numerous new metal cation neutralized high acid ionomer resins can be obtained by reacting a high acid copolymer (i.e. a copolymer containing greater than 16% by weight acid, preferably from about 17 to about 25 weight percent acid, and more preferably about 20 weight percent acid), with a metal cation salt capable of ionizing or neutralizing the copolymer to the extent desired (i.e. from about 10% to 90%).

The base copolymer is made up of greater than 16% by weight of an alpha, beta-unsaturated carboxylic acid and an alpha-olefin. Optionally, a softening comonomer can be included in the copolymer. Generally, the alpha-olefin has from 2 to 10 carbon atoms and is preferably ethylene, and the unsaturated carboxylic acid is a carboxylic acid having from about 3 to 8 carbons. Examples of such acids include acrylic acid, methacrylic acid, ethacrylic acid, chloroacrylic acid, crotonic acid, maleic acid, fumaric acid, and itaconic acid, with acrylic acid being preferred.

The softening comonomer that can be optionally included in the invention may be selected from the group consisting of vinyl esters of aliphatic carboxylic acids wherein the acids have 2 to 10 carbon atoms, vinyl ethers wherein the alkyl groups contains 1 to 10 carbon atoms, and alkyl acrylates or methacrylates wherein the alkyl group contains 1 to 10 carbon atoms. Suitable softening comonomers include vinyl acetate, methyl acrylate, methyl methacrylate, ethyl acrylate, ethyl methacrylate, butyl acrylate, butyl methacrylate, or the like.

Consequently, examples of a number of copolymers suitable for use to produce the high acid ionomers included in the present invention include, but are not limited to, high acid embodiments of an ethylene/acrylic acid copolymer, an ethylene/methacrylic acid copolymer, an ethylene/itaconic acid copolymer, an ethylene/maleic acid copolymer, an ethylene/methacrylic acid/vinyl acetate copolymer, an ethylene/acrylic acid/vinyl alcohol copolymer, etc. The base copolymer broadly contains greater than 16% by weight unsaturated carboxylic acid, from about 30 to about 83% by weight ethylene and from 0 to about 40% by weight of a softening comonomer. Preferably, the copolymer contains about 20% by weight unsaturated carboxylic acid and about 80% by weight ethylene. Most preferably, the copolymer contains about 20% acrylic acid with the remainder being ethylene.

Along these lines, examples of the preferred high acid base copolymers which fulfill the criteria set forth above, are a series of ethylene-acrylic copolymers which are commercially available from The Dow Chemical Company, Midland, Mich., under the "Primacor" designation. These high acid base copolymers exhibit the typical properties set forth below in Table 9.

TABLE 9

Typical Properties of Primacor Ethylene-Acrylic Acid Copolymers

| GRADE | PERCENT ACID | DENSITY, glcc | MELT INDEX, g/10 min | TENSILE YD. ST (psi) | FLEXURAL MODULUS (psi) | VICAT SOFT PT (° C.) | SHORE D HARDNESS |
|---|---|---|---|---|---|---|---|
| ASTM | | D-792 | D-1238 | D-638 | D-790 | D-1525 | D-2240 |
| 5980 | 20.0 | 0.958 | 300.0 | — | 4800 | 43 | 50 |
| 5990 | 20.0 | 0.955 | 1300.0 | 650 | 2600 | 40 | 42 |
| 5990 | 20.0 | 0.955 | 1300.0 | 650 | 3200 | 40 | 42 |
| 5981 | 20.0 | 0.960 | 300.0 | 900 | 3200 | 46 | 48 |
| 5981 | 20.0 | 0.960 | 300.0 | 900 | 3200 | 46 | 48 |
| 5983 | 20.0 | 0.958 | 500.0 | 850 | 3100 | 44 | 45 |
| 5991 | 20.0 | 0.953 | 2600.0 | 635 | 2600 | 38 | 40 |

[1]The Melt Index values are obtained according to ASTM D-1238, at 190° C.

Due to the high molecular weight of the Primacor 5981 grade of the ethylene-acrylic acid copolymer, this copolymer is the more preferred grade utilized in the invention.

The metal cation salts utilized in the invention are those salts which provide the metal cations capable of neutralizing, to various extents, the carboxylic acid groups of the high acid copolymer. These include acetate, oxide or hydroxide salts of lithium, calcium, zinc, sodium, potassium, nickel, magnesium, and manganese.

Examples of such lithium ion sources are lithium hydroxide monohydrate, lithium hydroxide, lithium oxide and lithium acetate. Sources for the calcium ion include calcium hydroxide, calcium acetate and calcium oxide. Suitable zinc ion sources are zinc acetate dihydrate and zinc acetate, a blend of zinc oxide and acetic acid. Examples of sodium ion sources are sodium hydroxide and sodium acetate. Sources for the potassium ion include potassium hydroxide and potassium acetate. Suitable nickel ion sources are nickel acetate, nickel oxide and nickel hydroxide. Sources of magnesium include magnesium oxide, magnesium hydroxide, magnesium acetate. Sources of manganese include manganese acetate and manganese oxide.

The new metal cation neutralized high acid ionomer resins are produced by reacting the high acid base copolymer with various amounts of the metal cation salts above the crystalline melting point of the copolymer, such as at a temperature from about 200° F. to about 500° F., preferably from about 250° F. to about 350° F. under high shear conditions at a pressure of from about 10 psi to 10,000 psi. Other well known blending techniques may also be used. The amount of metal cation salt utilized to produce the new metal cation neutralized high acid based ionomer resins is the quantity which provides a sufficient amount of the metal cations to neutralize the desired percentage of the carboxylic acid groups in the high acid copolymer. The extent of neutralization is generally from about 10% to about 90%.

As indicated below in Table 10, a number of new types of metal cation neutralized high acid ionomers can be obtained from the above indicated process. These include new high acid ionomer resins neutralized to various extents with manganese, lithium, potassium, calcium and nickel cations. In addition, when a high acid ethylene/acrylic acid copolymer is utilized as the base copolymer component of the invention and this component is subsequently neutralized to various extents with the metal cation salts producing acrylic acid based high acid ionomer resins neutralized with cations such as sodium, potassium, lithium, zinc, magnesium, manganese, calcium and nickel, several new cation neutralized acrylic acid based high acid ionomer resins are produced.

TABLE 10

Metal Cation Neutralized High Acid Ionomers

| Formulation No. | Wt-% Cation Salt | Wt-% Neutralization | Melt Index | C.O.R. | Shore D Hardness |
|---|---|---|---|---|---|
| 1(NaOH) | 6.98 | 67.5 | 0.9 | .804 | 71 |
| 2(NaOH) | 5.66 | 54.0 | 2.4 | .808 | 73 |
| 3(NaOH) | 3.84 | 35.9 | 12.2 | .812 | 69 |
| 4(NaOH) | 2.91 | 27.0 | 17.5 | .812 | (brittle) |
| 5(MnAc) | 19.6 | 71.7 | 7.5 | .809 | 73 |
| 6(MnAc) | 23.1 | 88.3 | 3.5 | .814 | 77 |
| 7(MnAc) | 15.3 | 53.0 | 7.5 | .810 | 72 |
| 8(MnAc) | 26.5 | 106 | 0.7 | .813 | (brittle) |
| 9(LiOH) | 4.54 | 71.3 | 0.6 | .810 | 74 |
| 10(LiOH) | 3.38 | 52.5 | 4.2 | .818 | 72 |
| 11(LiOH) | 2.34 | 35.9 | 18.6 | .815 | 72 |
| 12(KOH) | 5.30 | 36.0 | 19.3 | Broke | 70 |
| 13(KOH) | 8.26 | 57.9 | 7.18 | .804 | 70 |
| 14(KOH) | 10.7 | 77.0 | 4.3 | .801 | 67 |
| 15(ZnAc) | 17.9 | 71.5 | 0.2 | .806 | 71 |
| 16(ZnAc) | 13.9 | 53.0 | 0.9 | .797 | 69 |
| 17(ZnAc) | 9.91 | 36.1 | 3.4 | .793 | 67 |
| 18(MgAc) | 17.4 | 70.7 | 2.8 | .814 | 74 |
| 19(MgAc) | 20.6 | 87.1 | 1.5 | .815 | 76 |
| 20(MgAc) | 13.8 | 53.8 | 4.1 | .814 | 74 |
| 21(CaAc) | 13.2 | 69.2 | 1.1 | .813 | 74 |
| 22(CaAc) | 7.12 | 34.9 | 10.1 | .808 | 70 |
| 23(MgO) | 2.91 | 53.5 | 2.5 | .813 | |
| 24(MgO) | 3.85 | 71.5 | 2.8 | .808 | |
| 25(MgO) | 4.76 | 89.3 | 1.1 | .809 | |
| 26(MgO) | 1.96 | 35.7 | 7.5 | .815 | |
| 27(NiAc) | 13.04 | 61.1 | 0.2 | .802 | 71 |
| 28(NiAc) | 10.71 | 48.9 | 0.5 | .799 | 72 |
| 29(NiAc) | 8.26 | 36.7 | 1.8 | .796 | 69 |
| 30(NiAc) | 5.66 | 24.4 | 7.5 | .786 | 64 |

Controls:
50/50 Blend of Ioteks 8000/7030 C.O.R. = .810/65 Shore D Hardness
DuPont High Acid Surlyn ® 8422 (Na) C.O.R. = .811/70 Shore D Hardness
DuPont High Acid Surlyn ® 8162 (Zn) C.O.R. = .807/65 Shore D Hardness
Exxon High Acid Iotek EX-960 (Zn) C.O.R. = .796/65 Shore D Hardness
Control for Formulations 23–26 is 50/50 Iotek 8000/7030, C.O.R. = .814, Formulation 26 C.O.R. was normalized to that control accordingly
Control for Formulation Nos. 27–30 is 50/50 Iotek 8000/7030, C.O.R. = .807

When compared to low acid versions of similar cation neutralized ionomer resins, the new metal cation neutralized high acid ionomer resins exhibit enhanced hardness, modulus and resilience characteristics. These are properties that are particularly desirable in a number of thermoplastic fields, including the field of golf ball manufacturing.

When utilized in the construction of the inner layer of a multi-layered golf ball, it has been found that the new acrylic acid based high acid ionomers extend the range of hardness beyond that previously obtainable while maintaining the beneficial properties (i.e. durability, click, feel, etc.) of the softer low acid ionomer covered balls, such as balls produced utilizing the low acid ionomers disclosed in U.S. Pat. Nos. 4,884,814 and 4,911,451.

Moreover, as a result of the development of a number of new acrylic acid based high acid ionomer resins neutralized to various extents by several different types of metal cations, such as manganese, lithium, potassium, calcium and nickel cations, several new ionomers or ionomer blends are now available for production of an inner cover layer of a multi-layered golf ball. By using these high acid ionomer resins, harder, stiffer inner cover layers having higher C.O.R.s, and thus longer distance, can be obtained.

More preferably, it has been found that when two or more of the above-indicated high acid ionomers, particularly blends of sodium and zinc high acid ionomers, are processed to produce the covers of multi-layered golf balls, (i.e., the inner cover layer herein) the resulting golf balls will travel farther than previously known multi-layered golf balls produced with low acid ionomer resin covers due to the balls' enhanced coefficient of restitution values.

The low acid ionomers which may be suitable for use in formulating the inner layer compositions of the subject invention are ionic copolymers which are the metal, i.e., sodium, zinc, magnesium, etc., salts of the reaction product of an olefin having from about 2 to 8 carbon atoms and an unsaturated monocarboxylic acid having from about 3 to 8 carbon atoms. Preferably, the ionomeric resins are copolymers of ethylene and either acrylic or methacrylic acid. In some circumstances, an additional comonomer such as an acrylate ester (i.e., iso- or n-butylacrylate, etc.) can also be included to produce a softer terpolymer. The carboxylic acid groups of the copolymer are partially neutralized (i.e., approximately 10–75%, preferably 30–70%) by the metal ions. Each of the low acid ionomer resins which may be included in the inner layer cover compositions of the invention contains 16% by weight or less of a carboxylic acid.

When utilized in the construction of the inner layer of an additional embodiment of a multi-layered golf ball of the present invention, it has been found that the low acid ionomer blends extend the range of compression and spin rates beyond that previously obtainable. More preferably, it has been found that when two or more low acid ionomers, particularly blends of sodium and zinc high acid ionomers, are processed to produce the covers of multi-layered golf balls, (i.e., the inner cover layer herein) the resulting golf balls will travel farther and at an enhanced spin rate than previously known multi-layered golf balls. Such an improvement is particularly noticeable in enlarged or oversized golf balls.

With respect to the outer layer 12 of the preferred embodiment multi-layered cover of the present invention golf ball, the outer cover layer is comparatively softer than the inner layer. The softness provides for the enhanced feel and playability characteristics typically associated with balata or balata-blend balls. The outer layer or ply is comprised of a relatively soft, low modulus (about 1,000 psi to about 10,000 psi) and low acid (less than 16 weight percent acid) ionomer, ionomer blend or a non-ionomeric elastomer such as, but not limited to, a polyurethane, a polyester elastomer such as that marketed by DuPont under the trademark Hytrel®, a polyurethane sold by BASF under the designation Baytec® or a polyether amide such as that marketed by Elf Atochem S.A. under the trademark Pebax®. The outer layer is fairly thin (i.e. from about 0.010 to about 0.110 in thickness, more desirably 0.03 to 0.06 inches in thickness for a 1.680 inch ball and 0.04 to 0.07 inches in thickness for a 1.72 inch ball), but thick enough to achieve desired playability characteristics while minimizing expense.

Preferably, the outer layer includes a blend of hard and soft (low acid) ionomer resins such as those described in U.S. Pat. Nos. 4,884,814 and 5,120,791, both incorporated herein by reference. Specifically, a desirable material for use in molding the outer layer comprises a blend of a high modulus (hard), low acid, ionomer with a low modulus (soft), low acid, ionomer to form a base ionomer mixture. A high modulus ionomer herein is one which measures from about 15,000 to about 70,000 psi as measured in accordance with ASTM method D-790. The hardness may be defined as at least 50 on the Shore D scale as measured in accordance with ASTM method D-2240.

A low modulus ionomer suitable for use in the outer layer blend has a flexural modulus measuring from about 1,000 to about 10,000 psi, with a hardness of about 20 to about 40 on the Shore D scale.

The hard ionomer resins utilized to produce the outer cover layer composition hard/soft blends include ionic copolymers which are the sodium, zinc, magnesium or lithium salts of the reaction product of an olefin having from 2 to 8 carbon atoms and an unsaturated monocarboxylic acid having from 3 to 8 carbon atoms. The carboxylic acid groups of the copolymer may be totally or partially (i.e. approximately 15–75 percent) neutralized.

The hard ionomeric resins are likely copolymers of ethylene and either acrylic and/or methacrylic acid, with copolymers of ethylene and acrylic acid being the most preferred. Two or more types of hard ionomeric resins may be blended into the outer cover layer compositions in order to produce the desired properties of the resulting golf balls.

As discussed earlier herein, the hard ionomeric resins introduced under the designation Escor® and sold under the designation "Iotek" are somewhat similar to the hard ionomeric resins sold under the Surlyn® trademark. However, since the "Iotek" ionomeric resins are sodium or zinc salts of poly(ethylene-acrylic acid) and the Surlyn® resins are zinc or sodium salts of poly(ethylene-methacrylic acid) some distinct differences in properties exist. As more specifically indicated in the data set forth below, the hard "Iotek" resins (i.e., the acrylic acid based hard ionomer resins) are the more preferred hard resins for use in formulating the outer layer blends for use in the present invention. In addition, various blends of "Iotek" and Surlyn® hard ionomeric resins, as well as other available ionomeric resins, may be utilized in the present invention in a similar manner.

Examples of commercially available hard ionomeric resins which may be used in the present invention in formulating the inner and outer cover blends include the hard sodium ionic copolymer sold under the trademark Surlyn®8940 and the hard zinc ionic copolymer sold under the trademark Surlyn®9910. Surlyn®8940 is a copolymer of ethylene with methacrylic acid and about 15 weight percent acid which is about 29 percent neutralized with sodium ions. This resin has an average melt flow index of about 2.8. Surlyn®9910 is a copolymer of ethylene and methacrylic acid with about 15 weight percent acid which is about 58 percent neutralized with zinc ions. The average melt flow index of Surlyn®9910 is about 0.7. The typical properties of Surlyn®9910 and 8940 are set forth below in Table 11:

TABLE 11

| Typical Properties of Commercially Available Hard Surlyn ® Resins Suitable for Use in the Inner and Outer Layer Blends of the Present Invention | | | | | | | |
|---|---|---|---|---|---|---|---|
| | ASTM D | 8940 | 9910 | 8920 | 8528 | 9970 | 9730 |
| Cation Type | | Sodium | Zinc | Sodium | Sodium | Zinc | Zinc |
| Melt flow index, gms/10 min. | D-1238 | 2.8 | 0.7 | 0.9 | 1.3 | 14.0 | 1.6 |
| Specific Gravity, g/cm$^3$ | D-792 | 0.95 | 0.97 | 0.95 | 0.94 | 0.95 | 0.95 |
| Hardness, Shore D | D-2240 | 66 | 64 | 66 | 60 | 62 | 63 |
| Tensile Strength, | D-638 | (4.8) | (3.6) | (5.4) | (4.2) | (3.2) | (4.1) |
| (kpsi), MPa | | 33.1 | 24.8 | 37.2 | 29.0 | 22.0 | 28.0 |
| Elongation, % | D-638 | 470 | 290 | 350 | 450 | 460 | 460 |
| Flexural Modulus, | D-790 | (51) | (48) | (55) | (32) | (28) | (30) |
| (kpsi) MPa | | 350 | 330 | 380 | 220 | 190 | 210 |
| Tensile Impact (23° C.) | D-1822S | 1020 | 1020 | 865 | 1160 | 760 | 1240 |
| KJ/m$_2$ (ft.-lbs./in$^2$) | | (485) | (485) | (410) | (550) | (360) | (590) |
| Vicat Temperature, ° C. | D-1525 | 63 | 62 | 58 | 73 | 61 | 73 |

Examples of the more pertinent acrylic acid based hard ionomer resin suitable for use in the present inner and outer cover composition sold under the "Iotek" tradename by the Exxon Corporation include Iotek 4000, Iotek 4010, Iotek 8000, Iotek 8020 and Iotek 8030. The typical properties of these and other Iotek hard ionomers suited for use in formulating the inner and outer layer cover compositions are set forth below in Table 12:

TABLE 12

| Typical Properties of Iotek Ionomers | | | | | | | |
|---|---|---|---|---|---|---|---|
| | ASTM Method | Units | 4000 | 4010 | 8000 | 8020 | 8030 |
| Resin Properties | | | | | | | |
| Cation type | | | zinc | zinc | sodium | sodium | sodium |
| Melt index | D-1238 | g/10 min. | 2.5 | 1.5 | 0.8 | 1.6 | 2.8 |
| Density | D-1505 | kg/m$^3$ | 963 | 963 | 954 | 960 | 960 |
| Melting Point | D-3417 | ° C. | 90 | 90 | 90 | 87.5 | 87.5 |
| Crystallization Point | D-3417 | ° C. | 62 | 64 | 56 | 53 | 55 |
| Vicat Softening Point | D-1525 | ° C. | 62 | 63 | 61 | 64 | 67 |
| % Weight Acrylic Acid | | | 16 | | 11 | | |
| % of Acid Groups cation neutralized | | | 30 | | 40 | | |
| (3 mm thick, compression molded) | | | | | | | |
| Tensile at break | D-638 | MPa | 24 | 26 | 36 | 31.5 | 28 |
| Yield point | D-638 | MPa | none | none | 21 | 21 | 23 |
| Elongation at break | D-638 | % | 395 | 420 | 350 | 410 | 395 |
| 1% Secant modulus | D-638 | MPa | 160 | 160 | 300 | 350 | 390 |
| Plaque Properties | | | | | | | |
| Shore Hardness D | D-2240 | — | 55 | 55 | 61 | 58 | 59 |
| Film Properties (50 micron film 2.2:1 Blow-up ratio) | | | | | | | |
| Tensile at Break MD | D-882 | MPa | 41 | 39 | 42 | 52 | 47.4 |
| TD | D-882 | MPa | 37 | 38 | 38 | 38 | 40.5 |
| Yield point MD | D-882 | MPa | 15 | 17 | 17 | 23 | 21.6 |
| TD | D-882 | MPa | 14 | 15 | 15 | 21 | 20.7 |
| Elongation at Break | | | | | | | |
| MD | D-882 | % | 310 | 270 | 260 | 295 | 305 |
| TD | D-882 | % | 360 | 340 | 280 | 340 | 345 |
| 1% Secant modulus MD | D-882 | MPa | 210 | 215 | 390 | 380 | 380 |
| TD | D-882 | MPa | 200 | 225 | 380 | 350 | 345 |
| Dart Drop Impact | D-1709 | g/micron | 12.4 | 12.5 | 20.3 | | |

TABLE 12-continued

| Typical Properties of Iotek Ionomers | | | | | |
|---|---|---|---|---|---|
| | ASTM Method | Units | 7010 | 7020 | 7030 |
| Resin Properties | | | | | |
| Cation type | | | zinc | zinc | zinc |
| Melt Index | D-1238 | g/10 min. | 0.8 | 1.5 | 2.5 |
| Density | D-1505 | $kg/m^3$ | 960 | 960 | 960 |
| Melting Point | D-3417 | ° C. | 90 | 90 | 90 |
| Crystallization Point | D-3417 | ° C. | — | — | — |
| Vicat Softening Point | D-1525 | ° C. | 60 | 63 | 62.5 |
| % Weight Acrylic Acid | | | — | — | — |
| % of Acid Groups Cation Neutralized | | | — | — | — |
| Plaque Properties (3 mm thick, compression molded) | | | | | |
| Tensile at break | D-638 | MPa | 38 | 38 | 38 |
| Yield Point | D-638 | MPa | none | none | none |
| Elongation at break | D-638 | % | 500 | 420 | 395 |
| 1% Secant modulus | D-638 | MPa | — | — | — |
| Shore Hardness D | D-2240 | — | 57 | 55 | 55 |

Comparatively, soft ionomers are used in formulating the hard/soft blends of the inner and outer cover compositions. These ionomers include acrylic acid based soft ionomers. They are generally characterized as comprising sodium or zinc salts of a terpolymer of an olefin having from about 2 to 8 carbon atoms, acrylic acid, and an unsaturated monomer of the acrylate ester class having from 1 to 21 carbon atoms. The soft ionomer is preferably a zinc based ionomer made from an acrylic acid base polymer in an unsaturated monomer of the acrylate ester class. The soft (low modulus) ionomers have a hardness from about 20 to about 40 as measured on the Shore D scale and a flexural modulus from about 1,000 to about 10,000, as measured in accordance with ASTM method D-790.

Certain ethylene-acrylic acid based soft ionomer resins developed by the Exxon Corporation under the designation "Iotek 7520" (referred to experimentally by differences in neutralization and melt indexes as LDX 195, LDX 196, LDX 218 and LDX 219) may be combined with known hard ionomers such as those indicated above to produce the inner and outer cover layers. The combination produces higher C.O.R.s at equal or softer hardness, higher melt flow (which corresponds to improved, more efficient molding, i.e., fewer rejects) as well as significant cost savings versus the inner and outer layers of multi-layer balls produced by other known hard-soft ionomer blends as a result of the lower overall raw materials costs and improved yields.

While the exact chemical composition of the resins to be sold by Exxon under the designation Iotek 7520 is considered by Exxon to be confidential and proprietary information, Exxon's experimental product data sheet lists the following physical properties of the ethylene acrylic acid zinc ionomer developed by Exxon, set forth below in Table 13:

TABLE 13

| Property | ASTM Method | Units | Typical Value |
|---|---|---|---|
| Physical Properties of Iotek 7520 | | | |
| Melt Index | D-1238 | g/10 min. | 2 |
| Density | D-1505 | g/cc | 0.962 |
| Cation | | | Zinc |
| Melting Point | D-3417 | ° C. | 66 |
| Crystallization Point | D-3417 | ° C. | 49 |
| Vicat Softening Point | D-1525 | ° C. | 42 |
| Plaque Properties (2 mm thick Compression Molded Plaques) | | | |
| Tensile at Break | D-638 | MPa | 10 |
| Yield Point | D-638 | MPa | None |
| Elongation at Break | D-638 | % | 760 |
| 1% Secant Modulus | D-638 | MPa | 22 |
| Shore D Hardness | D-2240 | | 32 |
| Flexural Modulus | D-790 | MPa | 26 |
| Zwick Rebound | ISO 4862 | % | 52 |
| De Mattia Flex Resistance | D-430 | Cycles | >5000 |

In addition, test data collected by the inventors indicates that Iotek 7520 resins have Shore D hardnesses of about 32 to 36 (per ASTM D-2240), melt flow indexes of 3±0.5 g/10 min (at 190° C. per ASTM D-1288), and a flexural modulus of about 2500–3500 psi (per ASTM D-790). Furthermore, testing by an independent testing laboratory by pyrolysis mass spectrometry indicates that Iotek 7520 resins are generally zinc salts of a terpolymer of ethylene, acrylic acid, and methyl acrylate.

Furthermore, the inventors have found that a newly developed grade of an acrylic acid based soft ionomer available from the Exxon Corporation under the designation Iotek 7510, is also effective, when combined with the hard ionomers indicated above in producing golf ball covers exhibiting higher C.O.R. values at equal or softer hardness than those produced by known hard-soft ionomer blends. In this regard, Iotek 7510 has the advantages (i.e. improved flow, higher C.O.R. values at equal hardness, increased clarity, etc.) produced by the Iotek 7520 resin when compared to the methacrylic acid base soft ionomers known in the art (such as the Surlyn 8625 and the Surlyn 8629 combinations disclosed in U.S. Pat. No. 4,884,814).

In addition, Iotek 7510, when compared to Iotek 7520, produces slightly higher C.O.R. valves at equal softness/hardness due to the Iotek 7510's higher hardness and neutralization. Similarly, Iotek 7510 produces better release properties (from the mold cavities) due to its slightly higher stiffness and lower flow rate than Iotek 7520. This is important in production where the soft covered balls tend to have lower yields caused by sticking in the molds and subsequent punched pin marks from the knockouts.

According to Exxon, Iotek 7510 is of similar chemical composition as Iotek 7520 (i.e. a zinc salt of a terpolymer of ethylene, acrylic acid, and methyl acrylate) but is more highly neutralized. Based upon FTIR analysis, Iotek 7520 is estimated to be about 30–40 wt.-% neutralized and Iotek 7510 is estimated to be about 40–60 wt.-% neutralized. The typical properties of Iotek 7510 in comparison of those of Iotek 7520 are set forth below in Table 14:

TABLE 14

Physical Properties of Iotek 7510 in Comparison to Iotek 7520

| | IOTEK 7520 | IOTEK 7510 |
|---|---|---|
| MI, g/10 min | 2.0 | 0.8 |
| Density, g/cc | 0.96 | 0.97 |
| Melting Point, ° F. | 151 | 149 |
| Vicat Softening Point, ° F. | 108 | 109 |
| Flex Modulus, psi | 3800 | 5300 |
| Tensile Strength, psi | 1450 | 1750 |
| Elongation, % | 760 | 690 |
| Hardness, Shore D | 32 | 35 |

It has been determined that when hard/soft ionomer blends are used for the outer cover layer, good results are achieved when the relative combination is in a range of about 90 to about 10 percent hard ionomer and about 10 to about 90 percent soft ionomer. The results are improved by adjusting the range to about 75 to 25 percent hard ionomer and 25 to 75 percent soft ionomer. Even better results are noted at relative ranges of about 60 to 90 percent hard ionomer resin and about 40 to 60 percent soft ionomer resin.

Specific formulations which may be used in the cover composition are included in the examples set forth in U.S. Pat. Nos. 5,120,791 and 4,884,814. The present invention is in no way limited to those examples.

Moreover, in alternative embodiments, the outer cover layer formulation may also comprise a soft, low modulus non-ionomeric thermoplastic elastomer including a polyester polyurethane such as B.F. Goodrich Company's Estane® polyester polyurethane X4517. According to B.F. GOODRICH, Estane® X-4517 has the following properties as set forth below in Table 15:

TABLE 15

| Properties of Estane ® X-4517 | |
|---|---|
| Tensile | 1430 |
| 100% | 815 |
| 200% | 1024 |
| 300% | 1193 |
| Elongation | 641 |
| Youngs Modulus | 1826 |
| Hardness A/D | 88/39 |

TABLE 15-continued

| Properties of Estane ® X-4517 | |
|---|---|
| Bayshore Rebound | 59 |
| Solubility in Water | Insoluble |
| Melt processing temperature | >350° F. (>177° C.) |
| Specific Gravity ($H_2O$ = 1) | 1.1–1.3 |

Other soft, relatively low modulus non-ionomeric thermoplastic elastomers may also be utilized to produce the outer cover layer as long as the non-ionomeric thermoplastic elastomers produce the playability and durability characteristics desired without adversely effecting the enhanced spin characteristics produced by the low acid ionomer resin compositions. These include, but are not limited to thermoplastic polyurethanes such as: Texin® thermoplastic polyurethanes from Mobay Chemical Co. and the Pellethane® thermoplastic polyurethanes from Dow Chemical Co.; Ionomer/rubber blends such as those in Spalding U.S. Pat. Nos. 4,986,545; 5,098,105 and 5,187,013; and, Hytrel® polyester elastomers from DuPont and Pebax polyether amide from Elf Atochem S.A.

Similarly, a castable, thermosetting polyurethane produced by BASF under the trade designation Baytec® has also shown enhanced cover formulation properties. According to BASF, Baytec® (such as Baytec® RE 832), relates to a group of reactive elastomers having outstanding wear resistance, high mechanical strength, high elasticity and good resistance to weathering, moisture and chemicals. The Baytec® RE832 system gives the following typical physical properties set forth below in Table 16:

TABLE 16

| Property | ASTM Test Method | Unit | Value |
|---|---|---|---|
| Tear Strength Die C | D624 | pli | 180 |
| Stress at | | | |
| 100% Modulus | D412 | psi | 320 |
| 200% Modulus | | | 460 |
| 300% Modulus | | | 600 |
| Ultimate Strength | D412 | psi | 900 |
| Elongation at Break | D412 | % | 490 |
| Taber Abrasion | D460, H-18 | mg/1000 cycles | 350 |

| Component[1] Properties | Part A (Isocyanate) | Part B (Resin) |
|---|---|---|
| Viscosity @ 25° C., mPa · s | 2500 | 2100 |
| Density @ 25° C., g/cm | 1.08 | 1.09 |
| NCO, % | 9.80 | — |
| Hydroxyl Number, Mg KOH/g | — | 88 |

[1]Component A is a modified diphenylmethane diisocyanate (mDI) prepolymer and component B is a polyether polyol blend.

Filler Agents

The weight of the cover layers is increased in the present invention golf balls by making the cover layers thicker and through the inclusion of about 1 to about 100 parts per 100 parts resin of metal particles and other heavy weight filler materials. As used herein, the term "heavy weight filler materials" is defined as any material having a specific gravity greater than 1.0. This term "heavy weight filler materials" is used interchangeably with the term "weighting material" as also used herein. Furthermore, the term "density-adjusting" filler materials encompasses the weighting materials or heavy weight filler materials described herein. Specifically, the term density-adjusting filler materials refers to those materials that have a specific gravity which is different from the specific gravity of the layer within which such materials are incorporated. Accordingly, by selective incorporation of these density-adjusting filler materials into certain layers of a golf ball, the overall density of those layers may be selectively adjusted. And, the term "density-increasing" filler materials refers to certain density-adjusting filler materials that increase the specific gravity or density of the layer or layers within which they are incorporated.

As noted above, it has been found that increasing the weight of the ball towards the outer perimeter produces an increase in the ball's moment of inertia. Preferably, the particles (or flakes, fragments, fibers, etc.) of heavy filler are added to the inner cover layer as opposed to the outer cover, in order to increase the moment of inertia of the ball without affecting the ball's feel and durability characteristics. However, as described below, it may in some instances be preferred to incorporate weighting materials or heavy filler in the outer cover. This is particularly the case when producing a golf ball having a visible weighting system as described herein.

The inner layer is filled with one or more of a variety of reinforcing or non-reinforcing heavy weight fillers or fibers such as metal (or metal alloy) powders, carbonaceous materials (i.e., graphite, carbon black, cotton flock, leather fiber, etc.), glass, Kevlar® fibers (trademarked material of Du Pont for an aromatic polyamide fiber of high tensile strength and greater resistance of elongation than steel), etc. These heavy weight filler materials range in size from about 10 mesh to about 325 mesh, preferably about 20 mesh to about 325 mesh and most preferably about 100 mesh to about 325 mesh. Representatives of such metal (or metal alloy) powders include but are not limited to, bismuth powder, boron powder, brass powder, bronze powder, cobalt powder, copper powder, inconnel metal powder, iron metal powder, molybdenum powder, nickel powder, stainless steel powder, titanium metal powder, zirconium oxide powder, aluminum flakes, and aluminum tadpoles. It will be understood that the foregoing materials may be in other forms besides powders.

Examples of various suitable heavy filler materials which can be included in the present invention are set forth below in Table 17 as follows:

TABLE 17

| Filler Type | Spec. Gravity |
|---|---|
| graphite fibers | 1.5–1.8 |
| precipitated hydrated silica | 2.0 |
| clay | 2.62 |
| talc | 2.85 |
| asbestos | 2.5 |
| glass fibers | 2.55 |
| aramid fibers (Kevlar ®) | 1.44 |
| mica | 2.8 |
| calcium metasilicate | 2.9 |
| barium sulfate | 4.6 |
| zinc sulfide | 4.1 |
| silicates | 2.1 |
| diatomaceous earth | 2.3 |
| calcium carbonate | 2.71 |
| magnesium carbonate | 2.20 |
| Metals and Alloys (powders) | |
| titanium | 4.51 |
| tungsten | 19.35 |
| aluminum | 2.70 |
| bismuth | 9.78 |
| nickel | 8.90 |
| molybdenum | 10.2 |
| iron | 7.86 |
| copper | 8.94 |

TABLE 17-continued

| Filler Type | Spec. Gravity |
|---|---|
| brass | 8.2–8.4 |
| boron | 2.364 |
| bronze | 8.70–8.74 |
| cobalt | 8.92 |
| beryllium | 1.84 |
| zinc | 7.14 |
| tin | 7.31 |
| Metal Oxides | |
| zinc oxide | 5.57 |
| iron oxide | 5.1 |
| aluminum oxide | 4.0 |
| titanium dioxide | 3.9–4.1 |
| magnesium oxide | 3.3–3.5 |
| zirconium oxide | 5.73 |
| Metal Stearates | |
| zinc stearate | 1.09 |
| calcium stearate | 1.03 |
| barium stearate | 1.23 |
| lithium stearate | 1.01 |
| magnesium stearate | 1.03 |
| Particulate carbonaceous materials | |
| graphite | 1.5–1.8 |
| carbon black | 1.8 |
| natural bitumen | 1.2–1.4 |
| cotton flock | 1.3–1.4 |
| cellulose flock | 1.15–1.5 |
| leather fiber | 1.2–1.4 |

The amount and type of heavy weight filler material utilized is dependent upon the overall characteristics of the low spinning multi-layered golf ball desired. Generally, lesser amounts of high specific gravity materials are necessary to produce an increase in the moment of inertia in comparison to low specific gravity materials. Furthermore, handling and processing conditions can also affect the type of heavy weight filler material incorporated into cover layers. In this regard, Applicant has found that the inclusion of approximately 10 phr brass powder into an inner cover layer produces the desired increase in the moment of inertia without involving substantial processing changes. Thus, 10 phr brass powder is generally, the most preferred heavy filler material at the time of this writing.

Core

The core (preferably a solid core) is about 1.28 inches to 1.570 inches in diameter, preferably about 1.37 to about 1.54 inches, and most preferably 1.42 inches. The cores weigh about 18 to 39 grams, desirably 25 to 30, and most preferably about 29 grams. A wide array of cores can be utilized in the present invention golf balls. For example, solid cores, wound cores, and liquid cores can be employed.

The solid cores are typically compression molded from a slug of uncured or lightly cured elastomer composition comprising a high cis content polybutadiene and a metal salt of an alpha, beta, ethylenically unsaturated carboxylic acid such as zinc mono or diacrylate or methacrylate. To achieve higher coefficients of restitution in the core, the manufacturer may include fillers such as small amounts of a metal oxide such as zinc oxide. In addition, lesser amounts of metal oxide can be included in order to lighten the core weight so that the finished ball more closely approaches the U.S.G.A. upper weight limit of 1.620 ounces. Other materials may be used in the core composition including compatible rubbers or ionomers, and low molecular weight fatty acids such as stearic acid. Free radical initiators such as peroxides are admixed with the core composition so that on the application of heat and pressure, a complex curing cross-linking reaction takes place.

It will be understood that a wide array of other core configurations and materials could be utilized in conjunction with the present invention. For example, cores disclosed in U.S. Pat. Nos. 5,645,597; 5,480,155; 5,387,637; 5,150,906; 5,588,924; 5,507,493; 5,503,397; 5,482,286; 5,018,740; 4,852,884; 4,844,471; 4,838,556; 4,726,590; and 4,650,193; all of which are hereby incorporated by reference, may be utilized in whole or in part.

Preferred solid core compositions and resulting molded cores used in the present invention golf balls are manufactured using relatively conventional techniques. In this regard, the core compositions of the invention may be based on polybutadiene, and mixtures of polybutadiene with other elastomers. It is preferred that the base elastomer have a relatively high molecular weight. The broad range for the molecular weight of suitable base elastomers is from about 50,000 to about 500,000. A more preferred range for the molecular weight of the base elastomer is from about 100,000 to about 500,000. As a base elastomer for the core composition, cis-polybutadiene is preferably employed, or a blend of cis-polybutadiene with other elastomers may also be utilized. Most preferably, cis-polybutadiene having a weight-average molecular weight of from about 100,000 to about 500,000 is employed. Along this line, it has been found that the high cis-polybutadiene manufactured and sold by Shell Chemical Co., Houston, Tex., under the tradename Cariflex BR-1220, the high cis-polybutadiene sold by Bayer Corp. under the designation Taktene 220, and the polyisoprene available from Muehlstein, H & Co., Greenwich, Conn. under the designation "SKI 35" are particularly well suited.

The unsaturated carboxylic acid component of the core composition (a co-crosslinking agent) is the reaction product of the selected carboxylic acid or acids and an oxide or carbonate of a metal such as zinc, magnesium, barium, calcium, lithium, sodium, potassium, cadmium, lead, tin, and the like. Preferably, the oxides of polyvalent metals such as zinc, magnesium and cadmium are used, and most preferably, the oxide is zinc oxide.

Exemplary of the unsaturated carboxylic acids which find utility in the present core compositions are acrylic acid, methacrylic acid, itaconic acid, crotonic acid, sorbic acid, and the like, and mixtures thereof. Preferably, the acid component is either acrylic or methacrylic acid. Usually, from about 15 to about 25, and preferably from about 17 to about 21 parts by weight of the carboxylic acid salt, such as zinc diacrylate, is included in the core composition. The unsaturated carboxylic acids and metal salts thereof are generally soluble in the elastomeric base, or are readily dispersible.

The free radical initiator included in the core composition is any known polymerization initiator (a co-crosslinking agent) which decomposes during the cure cycle. The term "free radical initiator" as used herein refers to a chemical which, when added to a mixture of the elastomeric blend and a metal salt of an unsaturated, carboxylic acid, promotes crosslinking of the elastomers by the metal salt of the unsaturated carboxylic acid. The amount of the selected initiator present is dictated only by the requirements of catalytic activity as a polymerization initiator. Suitable initiators include peroxides, persulfates, azo compounds and hydrazides. Peroxides which are readily commercially available are conveniently used in the present invention, generally in amounts of from about 0.1 to about 10.0 and preferably in amounts of from about 0.3 to about 3.0 parts by weight per each 100 parts of elastomer.

Exemplary of suitable peroxides for the purposes of the present invention are dicumyl peroxide, n-butyl 4,4'-bis (butylperoxy) valerate, 1,1-bis(t-butylperoxy)-3,3,5-trimethyl cyclohexane, di-t-butyl peroxide and 2,5-di-(t-butylperoxy)-2,5 dimethyl hexane and the like, as well as mixtures thereof. It will be understood that the total amount of initiators used will vary depending on the specific end product desired and the particular initiators employed.

Examples of such commercially available peroxides are Luperco® 230 or 231 XL sold by Atochem, Lucidol Division, Buffalo, N.Y., and Trigonox® 17/40 or 29/40 sold by Akzo Chemie America, Chicago, Ill. In this regard Luperco® 230 XL and Trigonox® 17/40 are comprised of n-butyl 4,4-bis (butylperoxy) valerate; and, Luperco® 231 XL and Trigonox® 29/40 are comprised of 1,1-bis(t-butylperoxy)-3,3,5-trimethyl cyclohexane. The one hour half life of Luperco® 231 XL is about 112° C., and the one hour half life of Trigonox® 29/40 is about 129° C.

The core compositions of the present invention may additionally contain any other suitable and compatible modifying ingredients including, but not limited to, metal oxides, fatty acids, and diisocyanates and polypropylene powder resin. For example, Papi 94, a polymeric diisocyanate, commonly available from Dow Chemical Co., Midland, Mich., is an optional component in the rubber compositions. It can range from about 0 to 5 parts by weight per 100 parts by weight rubber (phr) component, and acts as a moisture scavenger. In addition, it has been found that the addition of a polypropylene powder resin results in a core which is too hard (i.e. exhibits low compression) and thus allows for a reduction in the amount of crosslinking agent utilized to soften the core to a normal or below normal compression.

Furthermore, because polypropylene powder resin can be added to core composition without an increase in weight of the molded core upon curing, the addition of the polypropylene powder allows for the addition of higher specific gravity fillers (if desired), such as mineral fillers. Since the crosslinking agents utilized in the polybutadiene core compositions are expensive and/or the higher specific gravity fillers are relatively inexpensive, the addition of the polypropylene powder resin substantially lowers the cost of the golf ball cores while maintaining, or lowering, weight and compression.

The polypropylene ($C_3H_5$) powder suitable for use in the present invention has a specific gravity of about 0.90 g/cm$^3$, a melt flow rate of about 4 to about 12 and a particle size distribution of greater than 99% through a 20 mesh screen. Examples of such polypropylene powder resins include those sold by the Amoco Chemical Co., Chicago, Ill., under the designations "6400 P", "7000 P" and "7200 P". Generally, from 0 to about 25 parts by weight polypropylene powder per each 100 parts of elastomer are included in the present invention.

Various activators may also be included in the compositions of the present invention. For example, zinc oxide and/or magnesium oxide are activators for the polybutadiene. The activator can range from about 2 to about 50 parts by weight per 100 parts by weight of the rubbers (phr) component. The amount of activation utilized can be reduced in order to lighten the weight of the core.

Moreover, reinforcement agents may be added to the composition of the present invention. As noted above, the specific gravity of polypropylene powder is very low, and when compounded, the polypropylene powder produces a lighter molded core. Further, when a lesser amount of activator is used, the core is also lighter. As a result, if necessary, higher gravity fillers may be added to the core composition so long as the specific core weight limitations are met. The amount of additional filler included in the core composition is primarily dictated by weight restrictions and preferably is included in amounts of from about 0 to about 100 parts by weight per 100 parts rubber.

Exemplary fillers include mineral fillers such as limestone, silica, mica, barytes, calcium carbonate, or clays. Limestone is ground calcium/magnesium carbonate and is used because it is an inexpensive, heavy filler.

As indicated, ground flash filler may be incorporated and is preferably 20 mesh ground up center stock from the excess flash from compression molding. It lowers the cost and may increase the hardness of the ball.

Fatty acids or metallic salts of fatty acids may also be included in the compositions, functioning to improve moldability and processing. Generally, free fatty acids having from about 10 to about 40 carbon atoms, and preferably having from about 15 to about 20 carbon atoms, are used. Exemplary of suitable fatty acids are stearic acid and linoleic acids, as well as mixtures thereof. Exemplary of suitable metallic salts of fatty acids include zinc stearate. When included in the core compositions, the fatty acid component is present in amounts of from about 1 to about 25, preferably in amounts from about 2 to about 15 parts by weight based on 100 parts rubber (elastomer).

Diisocyanates may also be optionally included in the core compositions. When utilized, the diisocyanates are included in amounts of from about 0.2 to about 5.0 parts by weight based on 100 parts rubber. Exemplary of suitable diisocyanates is 4,4'-diphenylmethane diisocyanate and other polyfunctional isocyanates known to the art.

Furthermore, the dialkyl tin difatty acids set forth in U.S. Pat. No. 4,844,471, the dispersing agents disclosed in U.S. Pat. No. 4,838,556, and the dithiocarbamates set forth in U.S. Pat. No. 4,852,884 may also be incorporated into the polybutadiene compositions of the present invention. The specific types and amounts of such additives are set forth in the above identified patents, which are incorporated herein by reference.

The core compositions of the invention are generally comprised of 100 parts by weight of a base elastomer (or rubber) selected from polybutadiene and mixtures of polybutadiene with other elastomers, 10 to 40 parts by weight of at least one metallic salt of an unsaturated carboxylic acid, and 1 to 10 parts by weight of a free radical initiator.

As indicated above, additional suitable and compatible modifying agents such as particulate polypropylene resin, fatty acids, and secondary additives such as Pecan shell flour, ground flash (i.e. grindings from previously manufactured cores of substantially identical construction), barium sulfate, zinc oxide, etc. may be added to the core compositions to adjust the weight of the ball as necessary in order to have the finished molded ball (core, cover and coatings) to closely approach the U.S.G.A. weight limit of 1.620 ounces.

In producing golf ball cores utilizing the present compositions, the ingredients may be intimately mixed using, for example, two roll mills or a Banbury® mixer until the composition is uniform, usually over a period of from about 5 to about 20 minutes. The sequence of addition of components is not critical. A preferred blending sequence is as follows.

The elastomer, polypropylene powder resin (if desired), fillers, zinc salt, metal oxide, fatty acid, and the metallic dithiocarbamate (if desired), surfactant (if desired), and tin difatty acid (if desired), are blended for about 7 minutes in an internal mixer such as a Banbury® mixer. As a result of shear during mixing, the temperature rises to about 200° F. The initiator and diisocyanate are then added and the mixing continued until the temperature reaches about 220° F. whereupon the batch is discharged onto a two roll mill, mixed for about one minute and sheeted out.

The sheet is rolled into a "pig" and then placed in a Barwell™ preformer and slugs are produced. The slugs are then subjected to compression molding at about 320° F. for about 14 minutes. After molding, the molded cores are cooled, the cooling effected at room temperature for about 4 hours or in cold water for about one hour. The molded cores are subjected to a centerless grinding operation whereby a thin layer of the molded core is removed to produce a round core having a diameter of 1.28 to 1.570 inches (preferably about 1.37 to about 1.54 inches and most preferably, 1.42 inches). Alternatively, the cores are used in the as-molded state with no grinding needed to achieve roundness.

The mixing is desirably conducted in such a manner that the composition does not reach incipient polymerization temperatures during the blending of the various components.

Usually the curable component of the composition will be cured by heating the composition at elevated temperatures on the order of from about 275° F. to about 350° F., preferably and usually from about 290° F. to about 325° F., with molding of the composition effected simultaneously with the curing thereof. The composition can be formed into a core structure by any one of a variety of molding techniques, e.g. injection, compression, or transfer molding. When the composition is cured by heating, the time required for heating will normally be short, generally from about 10 to about 20 minutes, depending upon the particular curing agent used. Those of ordinary skill in the art relating to free radical curing agents for polymers are conversant with adjustments of cure times and temperatures required to effect optimum results with any specific free radical agent.

In preparing golf balls in accordance with the present invention, a hard, relatively heavy, inner cover layer is molded (by injection molding or by compression molding) about a relatively light core (preferably a lighter and smaller solid core). A comparatively softer outer cover layer is molded over the inner cover layer.

The golf balls of the present invention can be produced by molding processes currently well known in the golf ball art. Specifically, the golf balls can be produced by injection molding or compression molding the relatively thick inner cover layer about smaller and lighter wound or solid molded cores to produce an intermediate golf ball having a diameter of about 1.38 to 1.68 inches, more preferably about 1.50 to 1.67 inches, and most preferably about 1.57 inches. The outer layer (preferably 0.010 inches to 0.110 inches in thickness) is subsequently molded over the inner layer to produce a golf ball having a diameter of 1.680 inches or more. Although either solid cores or wound cores can be used in the present invention so long as the size, weight and other physical perimeters are met, as a result of their lower cost and superior performance, solid molded cores are preferred over wound cores.

In compression molding, the inner cover composition is formed via injection at about 380° F. to about 450° F. into smooth surfaced hemispherical shells which are then positioned around the core in a mold having the desired inner cover thickness and subjected to compression molding at 200° F. to 300° F. for about 2 to 10 minutes, followed by cooling at 50° F. to 70° F. for about 2 to 7 minutes to fuse the shells together to form a unitary intermediate ball. In addition, the intermediate balls may be produced by injection molding wherein the inner cover layer is injected directly around the core placed at the center of an intermediate ball mold for a period of time in a mold temperature of from 50° F. to about 100° F. Subsequently, the outer cover layer is molded about the core and the inner layer by similar compression or injection molding techniques to form a dimpled golf ball of a diameter of 1.680 inches or more. After molding, the golf balls produced may undergo various further processing steps such as buffing, painting and marking as disclosed in U.S. Pat. No. 4,911,451.

While in accordance with the provisions of the patent statute the preferred forms and embodiments have been illustrated and described, it will be apparent to those of ordinary skill in the art that various changes and modifications may be made without deviating from the inventive concepts set forth above.

We claim:

1. A low spinning, multi-layer golf ball comprising:

a core assembly;

a first cover layer disposed on said core assembly;

a second cover layer disposed about said first cover layer, said second cover layer defining a plurality of dimples along the exterior surface of said second cover, the hardness of said second cover being less than the hardness of said first cover; and at least 10 parts by weight of a density-increasing filler material disposed in said second cover layer in an amount sufficient to decrease the spin rate of the golf ball;

wherein said filler material is a metal selected from the group consisting of brass, tungsten, bismuth, boron, bronze, cobalt, copper, inconnel metal, iron, molybdenum, nickel, stainless steel, zirconium oxide, aluminum, and combinations thereof.

2. The golf ball of claim 1, wherein said core assembly is a solid core.

3. The golf ball of claim 1, wherein said core assembly comprises a layer of a wound elastomer.

4. The golf ball of claim 1, wherein said core assembly comprises a liquid core.

5. The golf ball of claim 1, wherein said first cover layer comprises ionomer.

6. The golf ball of claim 5, wherein said ionomer is selected from the group consisting of magnesium ionomer, zinc ionomer, sodium ionomer, lithium ionomer, and blends thereof.

7. The golf ball of claim 1, wherein said second cover layer comprises a blend of a relatively soft ionomer and a relatively hard ionomer.

8. The golf ball of claim 1, wherein said second cover layer comprises a terpolymer ionomer.

9. The golf ball of claim 1, wherein said second cover layer has a Shore D hardness of from about 58 to about 65.

10. The golf ball of claim 9, wherein said second cover layer has a Shore D hardness of from about 60 to about 63.

11. The golf ball of claim 1, wherein said first cover layer is comprised of a material selected from the group consisting of an ionomer resin, a polyamide, a polyurethane, a polyphenylene oxide, and a polycarbonate.

12. The golf ball of claim 1, wherein said second cover layer is comprised of a material selected from the group consisting of an ionomer resin, a thermoplastic elastomer, a thermosetting elastomer, a polyurethane, a polyester and a polyether amide.

13. The golf ball of claim 1, wherein said first cover layer has a thickness of about 0.050 inches and said second cover layer has a thickness of about 0.055 inches.

14. The golf ball of claim 1, wherein said core assembly has a diameter of about 1.50 inches.

15. The golf ball of claim 1, wherein said golf ball has an outer diameter of about 1.71 inches.

16. The golf ball of claim 1, wherein said core assembly is formed of a soft compression material.

17. The golf ball of claim 1, wherein said first cover layer has a Shore D hardness of at least 65 and said second cover layer has a Shore D hardness of less than 65.

18. The golf ball of claim 1, wherein said plurality of dimples defined in said second cover layer are arranged in a pattern covering at least 70% of the surface area of said golf ball.

* * * * *